United States Patent [19]

Leonard

[11] 4,375,628

[45] Mar. 1, 1983

[54] CIRCUIT BREAKER

[75] Inventor: James H. Leonard, Albemarle, N.C.

[73] Assignee: Federal Pacific Electric Company, Newark, N.J.

[21] Appl. No.: 310,086

[22] Filed: Oct. 9, 1981

[51] Int. Cl.[3] ..... H01H 71/16

[52] U.S. Cl. ..... 337/75; 337/67

[58] Field of Search ..... 337/75, 67, 359

[56] References Cited

U.S. PATENT DOCUMENTS

| | | | |
|---|---|---|---|
| 2,681,396 | 6/1954 | Cole et al. | 337/67 |
| 2,810,048 | 10/1957 | Christensen | 337/75 |
| 2,876,308 | 8/1959 | Christensen | 337/75 |
| 3,101,399 | 8/1963 | Christensen | 337/75 |
| 3,500,275 | 3/1970 | Oravec | 337/75 |
| 3,581,261 | 5/1971 | De Torre et al. | 337/67 |
| 3,610,856 | 10/1971 | DeTorre | 337/67 |

*Primary Examiner*—Harold Broome

*Attorney, Agent, or Firm*—Ronald R. Stanley; Roy F. Hollander

[57] ABSTRACT

A circuit breaker has contacts which are engageable as a result of manual operation of a toggle mechanism causing the circuit breaker to close and open when the toggle is in an erect and collapsed condition, respectively. Subsequent opening of the circuit breaker is accomplished by either manual operation or automatic due to a current responsive latch within the toggle mechanism. As a result of a unique movable contact biasing arrangement, more uniform pressure is obtained between the contacts and a wiping action of the contacts is obtained during closing. The movable contact is mounted on a contact member pivoted at its center on a solid pin mounted in the breaker case through an elongated aperture in the contact member. The elongated aperture allows for a limited degree of movement of the contact member transverse to the pivot pin. It is this limited transverse movement which increases the tolerance range by providing overtravel of the movable contact and wiping action of the contacts.

7 Claims, 4 Drawing Figures

CIRCUIT BREAKER

BACKGROUND OF THE INVENTION

The present invention relates to manually operated circuit breakers and, more particularly, to circuit breakers having a movable contact on a spring biased contact member manually actuated through a toggle arrangement and automatically tripped by an overcurrent responsive mechanism.

The use of fuses has been declining in recent years due to circuit breakers which provide reusable electrical circuit protection. Circuit breakers enable an electrical circuit to be protected from a multitude of overcurrent and short-circuit situations with a manual resetting of the breaker rather than replacement of a fuse element. Generally, circuit breakers provide an exterior handle for manual opening and closing of the breaker which operates a pair of electrical contacts through a toggle arrangement, such as an overcenter linkage.

While the contacts are engaged to thus complete an electrical circuit it is important that sufficient pressure be applied to maintain engagement of the contacts and avoid arcing of the contact material. Further it has been found to be advantageous for the circuit breaker to operate quickly, in a snap-type action, during both opening and closing of the breaker in order to minimize the time during which arcing could occur. The contact pair consists of a stationary contact and a movable contact which may be attached to one end of a pivotally mounted contact member. If the pivoting mount for the contact member is a fixed position mount, wear of the contact due to arcing will result in lessening of the pressure between the two contacts. For this reason, overtravel of the movable contact is generally utilized to provide a wider tolerance range for engagement of the contact pair. In addition, it has been found that arcing of the contact pair may be diminished by providing a wiping action between the contacts as closing occurs.

Automatic circuit breakers include a mechanism for sensing overcurrent conditions as well as short-circuit conditions at current levels for which the appropriate breaker would be used. Any one of a number of known mechanisms for providing both overcurrent protection and short-circuit protection may be used in an automatic circuit breaker. When the circuit breaker automatically opens due to either over-current or short-circuit detection, it is desired that the physical opening of the contacts occur at as rapid a rate as possible to avoid arcing of the contact pair. In order to obtain the rapid opening of the contacts, mechanical mechanisms such as springs are often provided between the stationary and movable contacts. While the opening of the circuit breaker occurs at a speed dependent upon the force of the biasing spring provided between the contacts, manual closing of the breaker is likewise effected by this spring pressure.

U.S. Pat. Nos. 3,581,261 and 3,610,856 are illustrative of automatic circuit breakers which address all of the above noted problems. In each of these references, overtravel of the movable contact member is provided by a pivotal mount for the contact member. A helical coil spring extends through an aperture in the contact member and is mounted at either end in the circuit breaker case. During a majority of its use, the circuit breaker is in a closed condition, and thus the helical coil spring would be deflected. Fatigue of the coil spring, to any degree, lessens the tolerance range of the movable contact due to overtravel.

U.S. Pat. Nos. 2,876,308 and 3,101,399 illustrate circuit breakers using a solid pivot mount for a movable contact member with an elongated opening in the contact member. In each of these patents, the contact member is biased by a coil spring to one extreme of the elongated opening in the contact member. The tortuous path of the coil spring in each of these references can subject the spring to fatigue over an extended period of time.

A number of circuit breaker designs have been proposed including leaf-type springs for biasing movement of a pivotally mounted contact arm. U.S. Pat. No. 2,681,396 at FIGS. 27 through 36 illustrates a contact arm pivotally mounted within an elongated opening in a case structure of the breaker. The pivot, and thus contact arm, are normally biased toward an upper end of the elongated opening by reason of a bent leaf spring positioned between the pivot and a portion of the case structure. This leaf spring arrangement would present difficulties in assembly since the spring would be in a stressed condition while assembly was undertaken. Also, movement of the movable contact member is limited by the spring acting between the contact member and the breaker case.

U.S. Pat. No. 2,810,048 illustrates a circuit breaker having a contact arm pivotally mounted within a case. In this instance, the pivot is fixed in the case while the contact arm has an elongated hole through which the pivot supports the arm. A leaf-type spring, providing the only biasing for the linkage arrangement of the circuit breaker, is positioned between the actuating handle and a point on the contact arm. This spring acts both to bias the contacts to an open condition as well as support the contact arm in a raised position relative to the fixed pivot when the breaker is in an open condition.

U.S. Pat. No. 3,500,275 provides a leaf-type spring biasing a contact arm toward an upper end of an elongated pivotal mount. The leaf spring cooperates with a compression coil spring and, in fact, is operatively connected to the compression coil spring between the actuation handle and the contact arm. This arrangement of springs could present problems in assembly due to the multiple springs needing to be compressed for and during assembly.

SUMMARY OF THE INVENTION

In accordance with the present invention, a manually operable circuit breaker is provided with a spring mechanism providing limited transverse movement of a contact arm relative to a fixed pivot for the arm during operation of the breaker.

While the invention is illustrated and described in the attached specification as being applied to a single pole circuit breaker, the invention is equally apropos to multi-pole circuit breakers and may be used therewith.

It is an object of the present invention to provide a manually operable circuit breaker which allows for overtravel of at least one of the paired contacts of the breaker in order to enlarge the tolerance range of the breaker.

It is a further object of the present invention to provide a circuit breaker which allows limited transverse movement of a contact arm of the breaker in which uniform contact pressure is obtained and wiping action of the contacts occurs.

The use of the present invention provides an automatic circuit breaker capable of achieving the known and desired advantages of pivoted moving contact circuit breakers, i.e. contact overtravel, uniform contact pressure, contact wiping action, and tolerance forgiveness. The circuit breaker of the present design provides increased reliability, minimized fatigue and breakage of the pivot biasing means, increased calibration range and improved push-off operation.

The foregoing and other novel features, objects and advantages are better appreciated from the following detailed description of illustrated embodiments shown in the accompanying drawings.

DETAILED DESCRIPTION OF THE PREFERRED EMBODIMENT

Figure 1:
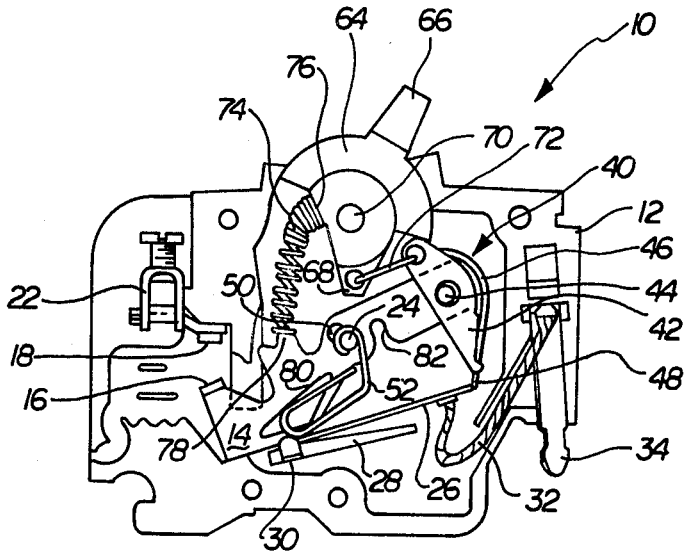
FIG. 1 is a side view of a circuit breaker constructed in accordance with the present invention, with a portion of the case structure removed, shown with paired contacts open.

Referring to FIG. 1, a circuit breaker 10 includes a case structure 12, only one-half of which is shown in the Figure. The case structure is constructed in halves which are essentially identical, and are molded from a plastic insulating material. The circuit breaker in FIG. 1 has one portion of the case structure removed to enable detailed observation of the internal components thereof. The major component of circuit breaker 10 is an elongated movable contact member 14. One end of the elongated member has a movable contact 16 permanently secured thereto as by welding and provides an upwardly facing, relatively flat contact surface. Supported within case structure 12 of the circuit breaker is a stationary contact 18 having a downwardly facing, relatively flat contact surface. Stationary contact 18 is intended to be connected to a conductor from the circuit to be protected by a clamp 22.

Elongated contact member 14 is pivotally mounted within case structure 12 by a pivot pin 24 mounted with appropriately molded formations in the case structure. Pivot pin 24 is fixed relative to the case structure allowing elongated contact member 14 to move relative to the pin. The pivoting of elongated member 14 within the case allows movable contact 16 to be engageable with and disengageable from stationary contact 18 at respective extremes of the rotation of the member.

Circuit breaker 10 includes a bimetallic element 26 specifically calculated to react to a predetermined level of current flowing therethrough to sense overcurrent. Bimetal element 26 is secured to the elongated contact member by clamping the bimetal element between the contact member and a ferromagnetic backing member 28. The permanent attachment of bimetal 26 and ferromagnetic backing member 28 to the contact member is accomplished by means of staking or crimping as shown at 30.

A braided electrical lead 32, preferably of copper, is secured to the free end of bimetal element 26. The free end of braided electrical lead 32 has a line stab 34 permanently secured thereto and arranged relative to case structure 12 to provide external access enabling connection into the electrical circuit to be protected. While connector 34 is shown as a spade or stab connection, any arrangement may be used which enables the circuit breaker to be connected into an electrical circuit. The arrangement of the connectors of circuit breaker 10 results in the circuit breaker having an electrical series relationship relative to the power supply and the load or apparatus to be powered by the supply.

At the end of the elongated contact member most remote from movable contact 16, a trip actuator 40 is secured to member 14. Trip actuator 40 includes a body portion 42 which is pivotally secured to the elongated contact member at a pivot 44 and a face or spring portion 46 which exteriorly overlies the edge of both body 42 and elongated contact member 14. A lower edge 48 of face 46 extends downwardly from trip actuator 40 and engages the free edge of bimetal portion 26. A collapsible link formed by actuator 40 and bimetal 26 is used to automatically operate circuit breaker 10. Pivot 44 of the trip actuator is insulated from the contact member such that no current bypasses bimetal portion 26 of the circuit breaker through the trip actuator.

Pivot 24 is a solid pin fixed in the case structure as noted above. Elongated contact member 14 has an elongated aperture 50 having a first dimension marginally larger than the diameter of pivot pin 24. A second dimension of aperture 50 is substantially larger than the diameter of pivot 24. As a result of the second dimension of aperture 50, elongated contact member 14 is able to move transverse to pivot pin 24 in addition to pivoting thereabout. The second dimension, and thus the elongated aperture, are positioned diagonally with respect to the contact member, from the upper left to the lower right as viewed in the Figures. The transverse movement of the elongated contact member provides the desired overtravel and wipe of movable contact 16 as noted hereinabove when provided with appropriate biasing.

Figure 2:
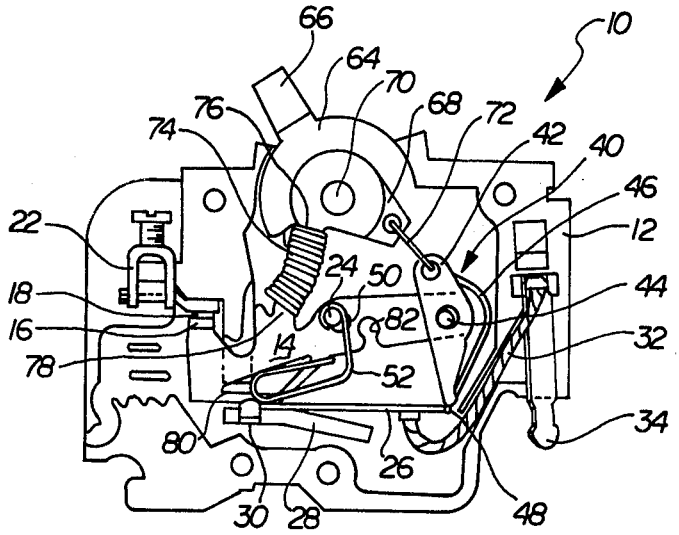
FIG. 2 is a side view of the circuit breaker shown in FIG. 1, illustrating a breaker constructed in accordance with the present invention, with a portion of the case structure removed, and with paired contacts closed.
Figure 3:
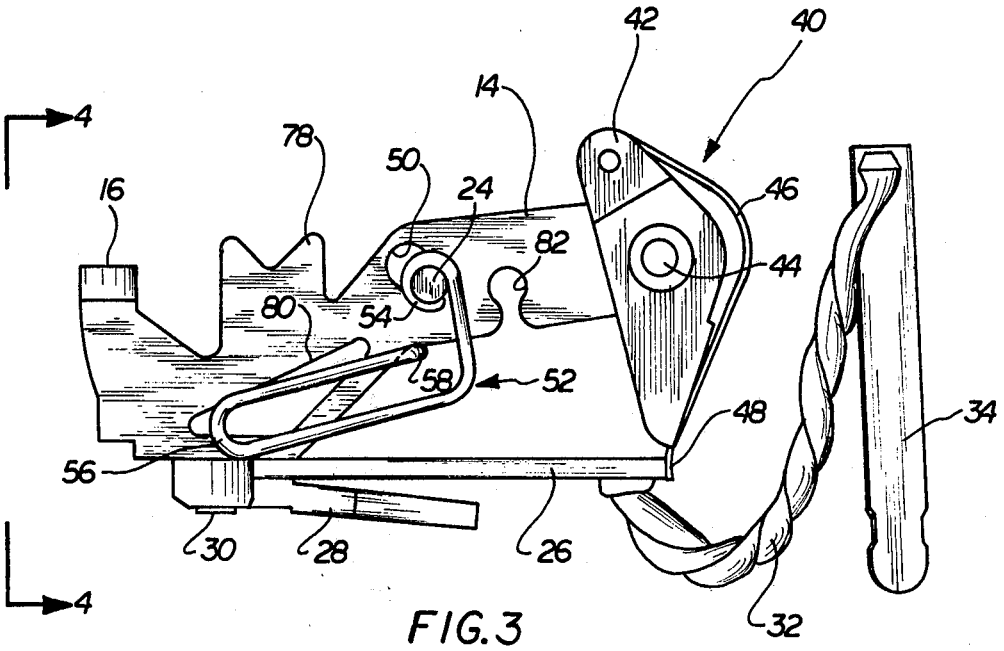
FIG. 3 is a plan view of a movable contact assembly constructed in accordance with the present invention and as used in FIGS. 1 and 2.
Figure 4:
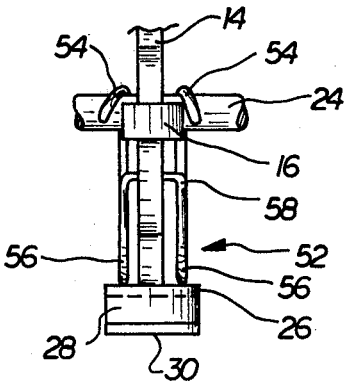
FIG. 4 is an end view of the moving contact assembly shown in FIG. 3.

A symmetrical spring 52 provides the appropriate biasing of elongated contact member 14 relative to stationary contact 18 and case structure 12. With the aid of FIGS. 3 and 4, it may be seen that the construction of spring 52 is symmetric relative to elongated contact member 14 and is supported between pivot pin 24 and the contact member. At each side of contact member 14 an ear 54 of spring 52 engages pivot pin 24 and is held thereby. Spring 52 includes a compression portion 56 at each side of the elongated member, which portions are connected by an integral crossover link 58 extending under the contact member. The tension of spring 52 forces contact member 14 up such that pivot pin 24 moves toward the bottom of elongated aperture 50 when the circuit breaker is open, as shown in FIG. 1. Correspondingly, closing of circuit breaker 10, as shown in FIG. 2, causes compression portion 56 of spring 52 to be compressed and forces the contact member downs such that pivot pin 24 moves toward the top of elongated aperture 50. Spring 52 therefore provides contact pressure between movable contact 16 and stationary contact 18 while further permitting overtravel of the contact carrying member 14 as more fully explained in U.S. Pat. No. 2,681,396.

Returning to FIGS. 1 and 2, a handle 64 has a lever 66 extending outwardly from case structure 12 of the circuit breaker and an arm 68 extending into the case structure. The handle is pivotally mounted within the case structure at a pivot 70. Lever 66 of the handle is movable from a first extreme, at the right as shown in FIG. 1, to a second extreme, at the left as shown in FIG. 2, corresponding to the opened and closed conditions of the circuit breaker, respectively. Arm 68 of handle 64 and the upper end of trip actuator 40 are pivotally connected by a toggle link 72 which may be formed from a stiff wire threaded through appropriate apertures in the arm and the actuator. A pushoff or compression spring 74 is interposed between a boss 76 on handle 64 and a boss 78 on elongated contact member 14. The compression spring biases both the elongated contact member and the handle toward their opened positions, as illustrated in FIG. 1. Compression spring 74 provides a strong contact opening biasing force when the breaker is closed as illustrated in FIG. 2.

In the closed configuration of the circuit breaker (FIG. 2), edge 48 of trip actuator 40 engages bimetal 26. The counterclockwise spring bias applied to contact carrying member 14 by spring 74 is resisted by the handle 64, link 72 and arm 68 when in an overcenter condition. Counterclockwise motion of handle 64, and thus the extreme of the overcenter condition, is resisted by the engaged contacts 16 and 18. In this manner, spring 74 provides a limited biasing force for the operation of handle 64 toward the contact opening direction. This bias is insufficient to open the breaker, however, due to the counterclockwise forces developed at pivot 70 when the circuit breaker is closed and latched due to the force exerted by spring 52 with contacts 16 and 18 serving as a pivot.

Interrupting capacity of circuit breaker 10 is dependent on the speed at which the contacts open upon occurrence of an overload. This speed is largely dependent upon the force which compression spring 74 provides. Any increase in the pressure of compression spring 74, however, results in a direct increase in effort necessary to operate handle 64 from the contact opened position, shown in FIG. 1, to the contact closed position, shown in FIG. 2.

The toggle mechanism, comprising arm 68, actuator 40 and link 72, locks the contacts closed, under the control of bimetal 26 which acts as a releasable latch. When current flow through the bimetal results in a sufficient heat buildup, downward deflection of bimetal 26 occurs and trip actuator 40 swings clockwise about pivot 44. Simultaneously, elongated contact member 14 is driven counterclockwise about pivot 24 by spring 74. The opened condition of circuit breaker 10, as seen in FIG. 1, provides toggle arm 68 and link 72 in a relaxed condition. As handle 64 is moved counterclockwise, toggle link 72 approaches its erect state and the handle tends to be progressively easier to operate as the toggle approaches the fully erect condition. Mechanical advantage realized as the toggle approaches its erect state makes movement relatively easier. When toggle link 72 becomes aligned or erect, no manual effort at handle 64 is needed to overcome the force of compression spring 74 or spring 52. A small amount of further motion occurs, and the toggle becomes overset thus locking the breaker closed. In this overset condition of the toggle, a clockwise biasing force on trip actuator 40 develops. The stress in compression spring 74 provides a large force that is available instantly to drive movable contact 16 open, that is, in a counterclockwise direction about pivot 24, when the overcurrent latch deflects downward and releases actuator 40.

Calibration of circuit breaker 10 for operation at a predetermined current rating is accomplished by adjusting the extent of overlap of face 48 with the edge of bimetal 26. Elongated contact member 14 has a triangular slot 80 cut therethrough near the intersection of the member and bimetal 26. A relatively thin portion of material remains near the intersection of the contact member and the bimetal as a result of the location of slot 80. This thin portion distorts when an appropriate article is inserted into slot 80 to change the angle between the contact member and the bimetal, and thus adjust the overlap of edge 48 and bimetal 26. Slot 80 provides for a considerable amount of adjustment and may be considered a coarse adjustment.

An additional or alternate adjustment of the overlap may be provided by the presence of a keyhole slot 82 extending through one edge of contact member 14 between pivot 24 and actuator 40. Since slot 80 is substantially distant from the intersection of the contact member and the bimetal, a fine adjustment is obtained by inserting an appropriate article into the slot and spreading the material and distance between pivot 24 and actuator 40.

Modifications, changes and improvements to the preferred forms of invention herein disclosed, described and illustrated may occur to those skilled in the art who come to understand the principles and precepts thereof. Accordingly, the scope of the invention should not be limited to the particular embodiments set forth herein, but rather should be limited only by the advance by which the invention has promoted the art.

What is claimed is:

1. In an automatic circuit breaker having an elongated movable contact arm carrying a movable contact, a companion contact engageable by said movable contact for closing a circuit, a current responsive latch carried by said movable contact arm, actuator means pivotally mounted on said movable contact arm and operatively connected to said contact arm under control of said latch for closing said circuit breaker, said contact arm having an aperture intermediate the movable contact and said actuator means, a contact member pivot extending through said aperture to support said contact arm, first spring means for biasing said movable contact away from said companion contact, and toggle means for operating said circuit breaker to engage and disengage said movable and companion contacts, the improvement comprising: said aperture providing limited movement of said contact arm transverse to said contact member pivot, and second spring means for biasing said contact arm to one extreme of said movement transverse to said contact member pivot, said second spring means positioned between said latch and said contact member.

2. The improvement according to claim 1 wherein said second spring means includes a portion secured to said contact member pivot.

3. The improvement according to claim 2 wherein said second spring means includes portions engaging said contact member and said latch.

4. The improvement according to claim 3 wherein said second spring means includes portions symmetrical with respect to said contact member.

5. A manually operable circuit breaker having an elongated movable contact member supported between its ends on a contact member pivot, said elongated movable contact member having a movable contact at one end, a stationary contact engageable by and disengageable from said movable contact when the circuit breaker is in a closed and open condition, respectively, said movable contact member having an actuator carried by an actuator pivot at the end of the movable contact member remote from said movable contact and supporting an overcurrent releasable latch normally restraining said actuator, a toggle mechanism including a pivoted handle and a link connected to said handle, said toggle mechanism being operable from a collapsed condition into an erect condition for operating said actuator and thereby operating said circuit breaker into the closed condition, a push-off spring biasing said circuit breaker toward said open condition, said contact member pivot extending through an aperture in said contact member, said aperture providing limited transverse movement of said contact member relative to said contact member pivot, an biasing means for constantly urging said contact member toward a first extreme of said limited transverse movement, said biasing means allowing said contact member to move toward a second extreme of said limited transverse movement when said circuit breaker is in said closed condition, said biasing means located between said contact member and said overcurrent latch.

6. The circuit breaker according to claim 5 wherein said biasing means includes a symmetrical spring.

7. The circuit breaker according to claim 6 wherein said symmetrical spring is secured to said contact member pivot and is compressed between said contact member and said overcurrent latch.

* * * * *